US007273377B2

(12) United States Patent
Seymour

(10) Patent No.: US 7,273,377 B2
(45) Date of Patent: Sep. 25, 2007

(54) BREADBOARD TO STACKABLE PLUG CONVERTOR

(75) Inventor: Arthur F. Seymour, Deerfield, IL (US)

(73) Assignee: Elenco Electronics, Inc., Wheeling, IL (US)

( * ) Notice: Subject to any disclaimer, the term of this patent is extended or adjusted under 35 U.S.C. 154(b) by 10 days.

(21) Appl. No.: 11/274,624

(22) Filed: Nov. 14, 2005

(65) Prior Publication Data

US 2007/0111573 A1 May 17, 2007

(51) Int. Cl.
*H01R 29/00* (2006.01)

(52) U.S. Cl. ..... 439/49; 434/118

(58) Field of Classification Search ..... 439/49; 434/118, 224, 301
See application file for complete search history.

(56) References Cited

U.S. PATENT DOCUMENTS 2,874,317 A * 2/1959 Couse ..... 310/71
3,548,261 A * 12/1970 Chambers ..... 361/807
4,650,425 A * 3/1987 McGarry ..... 434/219
5,339,219 A * 8/1994 Urich ..... 361/760
5,611,691 A 3/1997 Poulain
5,742,486 A * 4/1998 Yangkuai ..... 361/807
5,856,636 A * 1/1999 Sanso ..... 174/255
6,241,527 B1 * 6/2001 Rast ..... 434/327
6,430,017 B1 * 8/2002 Finlay et al. ..... 361/104
6,443,796 B1 * 9/2002 Shackelford ..... 446/91
6,452,399 B1 * 9/2002 Werner, Jr. ..... 324/458
6,459,587 B1 10/2002 Chan
6,650,548 B1 11/2003 Swetland
6,685,483 B2 2/2004 Blauvelt
6,895,563 B2 5/2005 Dixon
6,916,211 B2 7/2005 Price

* cited by examiner

*Primary Examiner*—Thanh-Tam Le
(74) *Attorney, Agent, or Firm*—Justin Lampel

(57) ABSTRACT

A housing used to combine a standard electronic prototype system and a modular block system with stackable connectors to achieve a design system that allows for safe assembly of circuits of a more complex nature than can be achieved by either system alone.

5 Claims, 2 Drawing Sheets

BREADBOARD TO STACKABLE PLUG CONVERTOR

BACKGROUND OF THE INVENTION

This invention relates generally to devices used with electronic circuits that easily and quickly connect together and specifically to electronic circuits constructed by teachers, students, or people doing electronic design. It enhances the ease of assembly and testing by combining breadboarding technology with stackable reusable electronic housings. There are breadboarding assembly aids that use a mechanical connector to quickly assemble electronic components into electronic circuits. These breadboarding aids have standard spacing between connectors in order to accept integrated circuit packages and many other electronic components. There also exist a quick connecting toy and educational system that places components on modular blocks for ease of assembly. There does not exist a quick and easy link between these two systems.

SUMMARY OF THE INVENTION

This invention consist of a housing used to combine the breadboarding aids and modular block systems to achieve a design system that allows for safe assembly of circuits of a more complex nature than achieved by either system alone. The housing contains a standard prototype area for the construction of electronic circuits. The housing also contains connectors designed to match existing modular connection systems to the prototype area.

Quick connect assembly systems currently being sold consist of a box of electronic devices mounted to quick connect bases. Diagrams for hundreds of circuits are included to educate a student or entertain a child. When these circuits are assembled the builder can listen to a radio station, send a flying saucer on a mission, create and store sounds . . . just to name a few. A base that allows the insertion of any integrated circuit with space for other required components to drive that circuit does not exist in this system.

In the engineering and technical fields you can find different prototyping blocks that allow the insertion of most integrated circuits with standard leads for breadboarding electronic circuits. These blocks are designed to build fairly complex circuits and accept many different types of electronic components. These blocks are not designed to mate or attach themselves with the quick connect systems described above.

The object of this invention is to create a housing that contains a prototyping block area and a quick connect assembly area, in order to combine the features of each system into a new system with extended advantages. This will allow the power supplies, motors, power transistors, movable wheeled bases, fans, meters, and many other quick connect devices to integrate with the more complex circuit designs on a breadboarding connection block.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE PREFERRED EMBODIMENT

Figure 1:
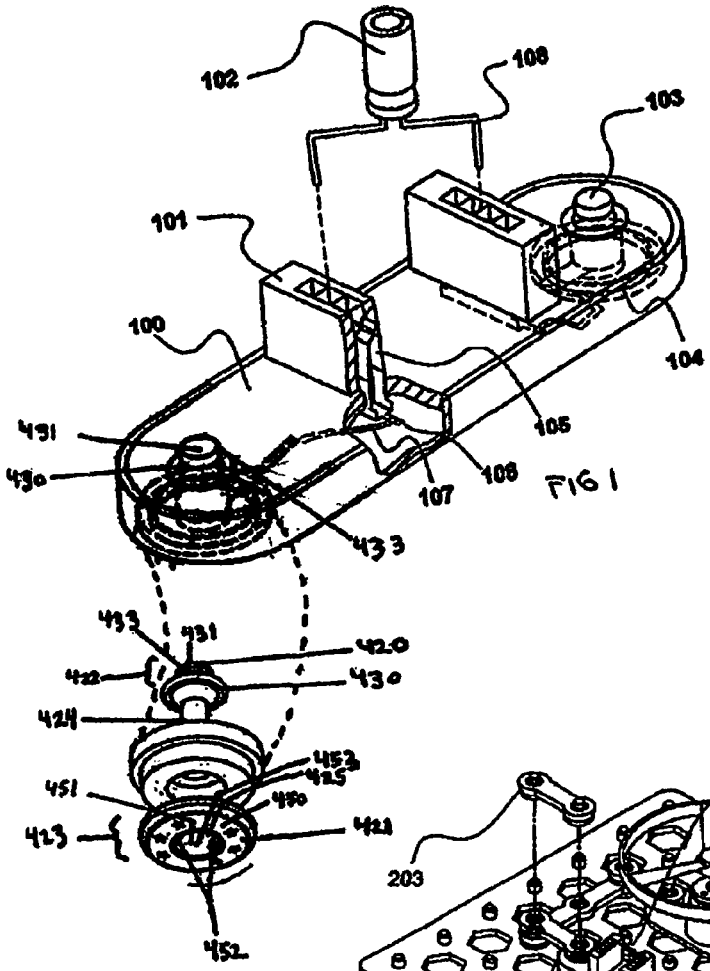
FIG. 1 shows a drawing of a housing 100 with unique stackable quick connect plugs, both male 103 and female 104, that connect to standard breadboard type clips 105 in the same housing 100.

The present invention consist of an improved housing convertor module 100 that contains breadboard type clips 105, 111. The breadboard clips 105, 111 are designed to mechanically accept, hold in place, and make electronic contact to the leads 108, 113 attached to electronic components similar to the capacitor 102 shown in FIG. 1. The breadboard clip 105 is electronically connected to the unique stackable plugs 109, 110 by a wire 107. The breadboard clip 111 is electronically connected to the unique stackable plugs 103, 104 by a wire 112. Using the housing convertor module 100 it is possible to quickly and efficiently connect electronic components used in electronic breadboarding to a system using stackable plug modules.

Figure 2:
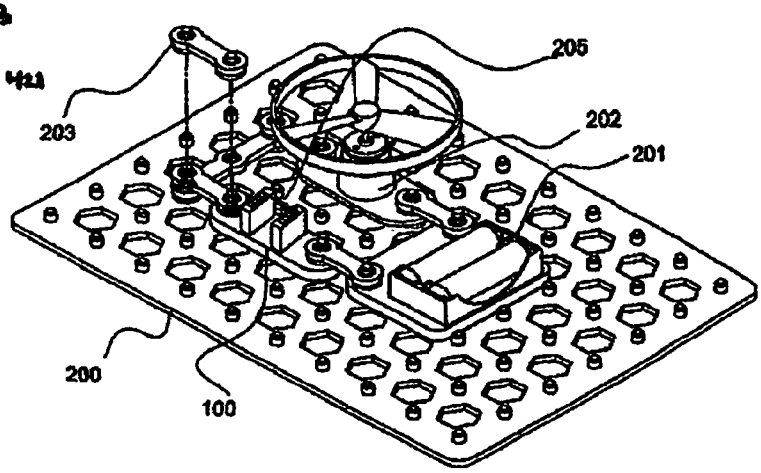
FIG. 2 shows how this housing 100 is used to connect to existing quick connect products 201, 202, and 203 that use the unique stackable quick connect plugs.
Figure 3:
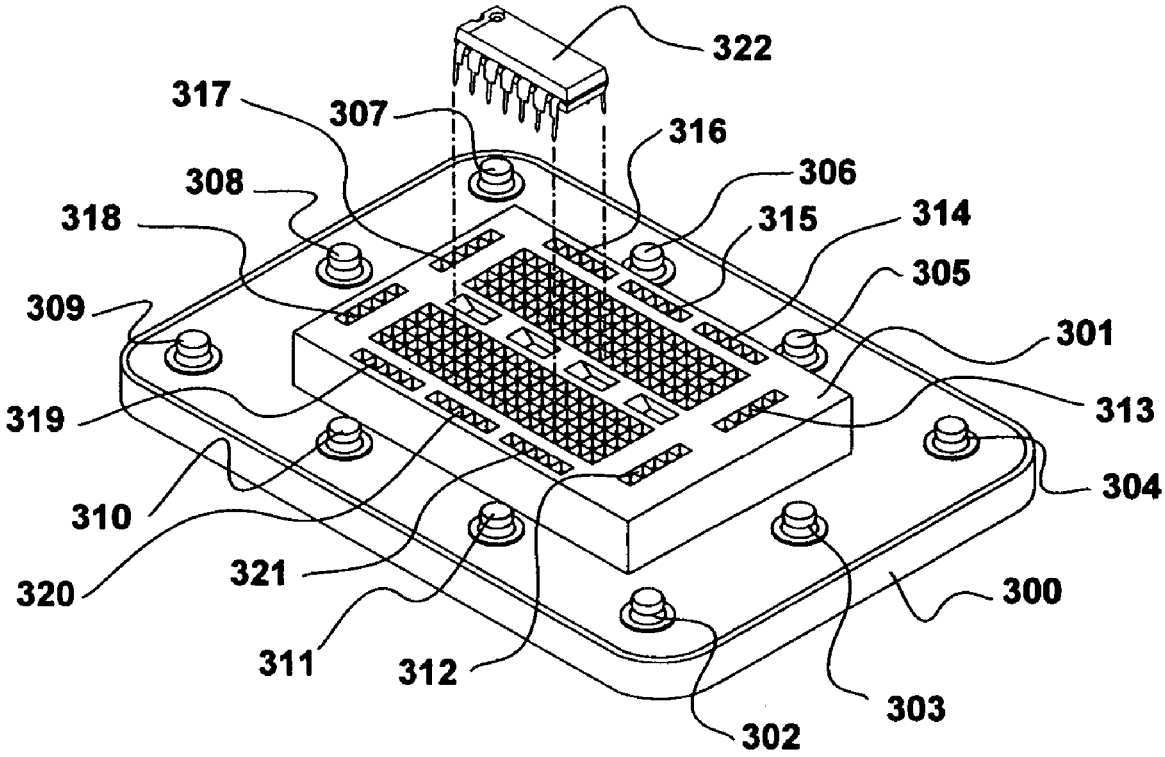
FIG. 3 shows a housing 300 with a breadboard area 301 and the quick connect plugs 302.

FIG. 2 shows a base 200 with existing stackable plug modules 201, 202, 203 and the housing convertor module 100. In FIG. 2 the battery holder module 201 is connected to a motor module 202 using short stackable connection module strips 203. By adding the convertor module 100 a standard resistor 205 can be placed in series with battery 201 and module strip 203. Since the convertor module 100 accepts electronic components directly, it is not necessary to remove the convertor module 100 to change the value of the resistor 205. Since convertor module 100 can hold up to four (4) parts, three (3) more electronic components having two (2) leads could be placed in parallel with resistor 205 without adding or changing a stackable plug module. The convertor module 100 can be modified to hold electronic devices with more than two (2) leads. FIG. 3 shows a standard electronic breadboard area 301 as part of a Breadboard convertor module 300. The unique stackable plug 302 is electronically connected to the breadboard clip 312. In a similar manner the unique stackable plugs 303-311 are electronically connected to breadboard clips 313-321 respectively. The center part of the breadboard area 301 is used to interconnect electronic components as complicated as, but not limited to, the integrated circuit 322 shown in FIG. 3.

The quick connect module 100 may have a top side 420 and a bottom side 421.

The top side 420 of the quick connect module 400 may have a male member 422 and the bottom side 421 of the quick connect module 400 may have the female member 423. The male member 422 may be connected to the female member 423 via a shaft 424. Accordingly, the male member 422 of quick connect module 400 may not be inserted into the female member 423 of the same quick connect module 400. Instead, the male member 422 of one quick connect module 400 may be inserted into the female member 423 of a different quick connect module 400 or other component. Further, both the male member 422 and the female member 423 may conduct electricity.

The male member 422 may be snap-fittingly coupled with a female member 423. The male member 422 portion of the quick connect module 400 may have a circular plate-like base 430 and a plug 431 integral therewith. The plug 431 of the male member 422 has an outwardly directed semi-circular locking projection 433 engageable with rods 452 of the female member 423 (as is described below).

The female member 423 portion of the quick connect module 400 may have a circular plate-like base 450 and a cylindrical socket 451 disposed on the underside of and integral with the base 450. The base 450 may have a central bore 453 for receiving the male member 422. Located within the central bore 453 may be two rods 452. The rods 452 may be substantially parallel with the bottom side 421 of the quick connect module 400. A cavity 425 may be located above the rods 452 and within the central bore 453. A spring may be located within the female member 423 portion whereby the spring provides pressure which forces the rods 452 toward the center of the central bore 453. While the male member 422 is inserted into the central bore 453 of the female member 423, the outwardly directed semi-circular locking projection 433 of the male member 422 may contact the rods 452 and force the rods 452 away from the center of the central bore 453.

When the outwardly directed semi-circular locking projection 433 portion of the male member 422 has been fully inserted into the female member 423, the outwardly directed semi-circular locking projection 433 may reside within the cavity 425 of the female member 423 and the springs may force the rods 452 inward toward the center of the central bore 453. In this position the male member 422 is removably secured within the female member 423 by the rods 452 which are secured by the springs. The male member 422 may be removed from the female member 423 by applying force to overcome the tension created by the springs in holding the rods 452 under the outwardly directed semi-circular locking projection 433.

What is claimed is:

1. A quick connect circuit module, comprising:

a housing comprising an electronically non-conductive module portion with substantially planar face portions and snap-fitting female electronically conductive connectors connected to said module portion, said electronically conductive connectors comprising electronically conductive male connectors extending outwardly from and connected to one of said face portions of said module and electronically conductive female connectors electronically connected to said electronically conductive male connectors on an opposite face portion of said module, said female connectors being complementary to said male connectors of said module to snap-fittingly receive and matingly engage the male connectors of said module to releasably secure, interlockingly couple and mechanically attach said modules to other said modules, and said female connectors being complementary to said male connectors of other modules to snap-fittingly receive and matingly engage the male connectors of said other modules to releasably secure, interlockingly couple, mechanically attach and electronically connect said modules to each other;

said modules comprising a component-receiving breadboard area with at least two connector strips for receiving and releasably engaging more than one of said electronic components to provide a solderless electronic connection for the building of electronic circuits.

2. A quick connect circuit module in accordance with claim 1 wherein said electronic components are selected from the group of: capacitors, resistors, diodes, light emitting diodes LED, inductors, transistors, semiconductors, triodes, electronic sound emitters, speakers, buzzers, microphones, light bulbs, strobe lights, switches, integrated circuits, and combinations thereof.

3. A quick connect circuit module in accordance with claim 1 wherein said electronically conductive connectors comprise:

metal male connectors selected from the group consisting of snaps, pegs, pins, posts, pedestals, and plugs; and metal female connectors selected from the group consisting of sockets, receptacles, grommets, rings, and tubes; and metal female breadboard connectors selected from the group consisting of sockets, receptacles, clips, springs, and tubes.

4. A quick connect circuit module in accordance with claim 1 wherein:

said non-conductive portion comprises a material selected from the group consisting of plastic, wood, paperboard, cardboard, and rubber.

5. A quick connect circuit module in accordance with claim 1 wherein said components-receiving connector strips comprise electronically conductive contacts selected from the group consisting of: clip springs, interference metal clips, and wire springs.

* * * * *